US010513422B2

(12) United States Patent
Cheung

(10) Patent No.: US 10,513,422 B2
(45) Date of Patent: Dec. 24, 2019

(54) VEHICLE JACK AND ADAPTER THEREFOR

(71) Applicant: VOLKSWAGEN OF AMERICA, INC., Herdon, VA (US)

(72) Inventor: Alan Cheung, Ashburn, VA (US)

(73) Assignee: VOLKSWAGEN OF AMERICA, INC., Herndon, VA (US)

( * ) Notice: Subject to any disclaimer, the term of this patent is extended or adjusted under 35 U.S.C. 154(b) by 315 days.

(21) Appl. No.: 15/468,826

(22) Filed: Mar. 24, 2017

(65) Prior Publication Data

US 2018/0273359 A1 Sep. 27, 2018

(51) Int. Cl.

*B66F 3/12* (2006.01)
*B66F 13/00* (2006.01)
*B66F 3/22* (2006.01)

(52) U.S. Cl.

CPC ..... *B66F 3/12* (2013.01); *B66F 3/22* (2013.01); *B66F 13/00* (2013.01)

(58) Field of Classification Search

CPC ..... B66F 13/00
See application file for complete search history.

(56) References Cited

U.S. PATENT DOCUMENTS 1,563,001 A * 11/1925 Weaver ..... B66F 1/06 254/2 B
2,536,550 A * 1/1951 Hughes ..... B66F 5/00 254/133 R
2,621,891 A * 12/1952 Marsh ..... B66F 3/12 254/10 B
3,245,659 A * 4/1966 Nolden ..... B66F 3/36 254/134
3,317,188 A * 5/1967 Linscott ..... B66F 3/36 248/357
3,830,470 A * 8/1974 Gibson ..... B66F 3/36 254/133 R
4,558,848 A * 12/1985 Rutter ..... B66F 3/12 254/100
4,848,733 A * 7/1989 Yamauchi ..... B66F 3/12 254/126
5,011,118 A * 4/1991 Brosius ..... B66F 3/12 254/126
5,135,201 A * 8/1992 Engel ..... B66F 3/12 254/126
5,199,688 A * 4/1993 Engel ..... B66F 3/12 254/126

(Continued)

FOREIGN PATENT DOCUMENTS

AU 2009100418 A4 6/2009
CN 2294947 Y 10/1998

(Continued)

OTHER PUBLICATIONS

Extended European Search Report dated Aug. 13, 2018, for European Patent Application No. 18163792.7.

*Primary Examiner* — Tyrone V Hall, Jr.
(74) *Attorney, Agent, or Firm* — Karceski IP Law, PLLC

(57) ABSTRACT

A vehicle jack includes a lift element, an operative element operably connected to the lift element to transition the lift element from a first position to a second position, where the first position differs in elevation from the second position, and an extension element affixed to the lift element. The extension element has a bottom side that establishes a stable interface with the lift element.

19 Claims, 13 Drawing Sheets

(56) References Cited

U.S. PATENT DOCUMENTS

| | | | | | |
|---|---|---|---|---|---|
| D340,566 | S | * | 10/1993 | Thomas | D34/28 |
| 5,379,987 | A | * | 1/1995 | Cleary | B66F 3/38 254/134 |
| 5,386,969 | A | * | 2/1995 | Popowich | B66F 3/12 254/126 |
| 5,516,066 | A | * | 5/1996 | Fabiano | B66F 3/12 254/122 |
| 5,697,598 | A | * | 12/1997 | Fabiano | B66F 3/12 254/126 |
| 6,000,681 | A | * | 12/1999 | Hussaini | B66F 3/38 254/101 |
| 6,168,138 | B1 | * | 1/2001 | Dhein | B25H 1/0014 254/134 |
| 6,189,863 | B1 | * | 2/2001 | Blackburn | B66F 5/04 254/131 |
| 6,695,289 | B1 | * | 2/2004 | Mickael | B66F 3/12 187/211 |
| 7,168,685 | B2 | * | 1/2007 | Miner | B66F 5/00 254/8 B |
| 2005/0092975 | A1 | * | 5/2005 | Tarra | B66F 3/12 254/122 |
| 2005/0218385 | A1 | * | 10/2005 | Lemelson | B66F 3/12 254/126 |

FOREIGN PATENT DOCUMENTS

| | | | |
|---|---|---|---|
| FR | 976518 | A | 3/1951 |
| WO | 2008104931 | A1 | 9/2008 |

* cited by examiner

VEHICLE JACK AND ADAPTER THEREFOR

CROSS-REFERENCE TO RELATED APPLICATION(S)

This U.S. Patent Application is a first-filed patent application and does not rely for priority on any other patent application.

FIELD OF THE INVENTION

The present invention concerns a vehicle jack and an adapter therefor. More specifically, the present invention concerns a vehicle jack that is constructed to provide an extension element that assists with the lifting of a vehicle while avoiding any obstructions, such as assist steps, that may interfere with the operation of the vehicle jack. The present invention also provides for an adapter, encompassing an extension element, which may be attached to a vehicle jack to help lift a vehicle while avoiding any obstructions presented by the vehicle.

DESCRIPTION OF THE BACKGROUND AND RELATED ART

As should be apparent to those skilled in the art, the prior art describes jacks that assist with the lifting of a vehicle. Specifically, such jacks are contemplated to be placed on the ground and manipulated by a user to engage the vehicle, lifting the vehicle from the ground. Vehicle jacks are used for many purposes, including lifting the vehicle to change a tire, for example.

As also should be apparent to those skilled in the art, vehicles include a wide variety of configurations. Some vehicles include obstructions, such as assist steps, that may interfere with the operation of the vehicle jack by impacting with a portion of the jack.

As such, a desire has arisen for a construction of a vehicle jack that is operable with vehicles that present one or more obstructions to the operation of a jack.

A further desire is for a construction of a vehicle jack that may be used without physically modifying the obstruction or obstructions on the vehicle.

SUMMARY OF THE INVENTION

The present invention addresses one or more of the deficiencies with respect to the prior art.

In one contemplated embodiment, the present invention provides a vehicle jack that includes a lift element and an operative element operably connected to the lift element to transition the lift element from a first position to a second position. The first position differs in elevation from the second position. The vehicle jack also includes an extension element affixed to the lift element. The extension element has a bottom side that establishes a stable interface with the lift element.

In another embodiment, the lift element is contemplated to include a base, a lift plate with a top side defining a first area, and a plurality of scissor elements connecting the base to the lift plate. The bottom side of the extension element defines a second area.

A ratio of the first area to the second area is between 0.8-1.2. Alternatively, it is contemplated that the ratio may be between 0.9-1.1. Separately, the ratio may be between 0.95-1.05. Still further, the ratio may be 1.0.

In a further embodiment, the extension element may have a body, a first attachment element associated with a first side of the body, and a second attachment element associated with the second side of the body. The first attachment element and the second attachment element engage the lift plate to secure the body to the lift plate.

The body may include a detent in a top side for engagement with a frame element on a vehicle.

In embodiments of the vehicle jack of the present invention, the operative element may include an eyelet, a rod connected to the eyelet, a first socket engaging a first end of the rod and the plurality of scissor elements, and a second socket engaging a second end of the rod and the plurality of scissor element. Rotation of the eyelet causes rotation of the rod and rotation of the rod causes the first and second sockets to move therealong, thereby causing the first and second sockets to move in relation to one another. Still further, as the first and second sockets move along the rod, the plurality of scissor elements cause the base and the lift plate to move in relation to one another.

With respect to selected embodiments of the present invention, it is contemplated that the vehicle jack may be constructed such that the first attachment element is attached to a first side of the body and the second attachment is attached to a second side of the body.

Still further, the vehicle jack may be constructed so that the extension element also includes a nut and a bolt with a shaft. In this embodiment, the first attachment element is secured against a first side of the body, the second attachment element is secured against a second side of the body, and the shaft extends through the body, the first attachment element, and the second attachment element so that the nut and the bolt sandwich the body between the first attachment element and the second attachment element.

Separately, the vehicle jack may be made so that the plurality of scissor elements include a first scissor element, a second scissor element, a third scissor element, and a fourth scissor element. The plurality of scissor elements are contemplated to connect to one another to form a diamond shape.

In another embodiment of the vehicle jack, the first and second scissor elements are contemplated to connect at first ends to the base. The first and second elements connect at second ends to third ends of the third and fourth scissor elements. In addition, the third and fourth scissor elements connect at fourth ends to the lift plate.

It is contemplated that the lift element is made from at least one material selected from steel, aluminum, alloys of aluminum, iron, alloys of iron, nickel, alloys of nickel, titanium, alloys of titanium, magnesium, alloys of magnesium, natural materials, composite materials, carbon fiber composite materials, ceramics, and/or plastics.

In addition, it is contemplated that the extension element is made from at least one material selected from steel, aluminum, alloys of aluminum, iron, alloys of iron, nickel, alloys of nickel, titanium, alloys of titanium, magnesium, alloys of magnesium, natural materials, composite materials, carbon fiber composite materials, ceramics, and/or plastics.

Furthermore, it is contemplated that the operative element is made from at least one material selected steel, aluminum, alloys of aluminum, iron, alloys of iron, nickel, alloys of nickel, titanium, alloys of titanium, magnesium, alloys of magnesium, natural materials, composite materials, carbon fiber composite materials, ceramics, and/or plastics.

The present invention also provides for an extension element for a vehicle jack. The extension element includes a body with a bottom side defining a first area that is adapted to be positioned atop a lift element having a top side with a second area, a first attachment element associated with a first side of the body, and a second attachment element associated with the second side of the body. The first attachment element and the second attachment element engage the lift element to secure the body to the lift element. The bottom side that establishes a stable interface with the lift element.

Here, the extension element may be constructed so that a ratio of the first area to the second area is between 0.8-1.2. In an further embodiment, the ratio may be between 0.9-1.1. Alternatively, the ratio may be between 0.95-1.05. Still further, the ratio may be 1.0.

Further aspects of the present invention will be made apparent from the paragraphs that follow.

BRIEF DESCRIPTION OF THE DRAWING(S)

The present invention will now be described in connection with the drawings appended hereto, in which.

DETAILED DESCRIPTION OF EMBODIMENT(S) OF THE INVENTION

The present invention will now be described in connection with one or more embodiments thereof. The discussion of the embodiments is not intended to be limiting of the present invention. To the contrary, any discussion of embodiments is intended to exemplify the breadth and scope of the present invention. As should be apparent to those skilled in the art, variations and equivalents of the embodiment(s) described herein may be employed without departing from the scope of the present invention. Those variations and equivalents are intended to be encompassed by the scope of the present patent application even if not discussed in detail herein.

It is noted that the present invention is described in connection with vehicles, particularly automobiles. However, the present invention is not intended to be limited to automobiles. The term "vehicle" is intended to encompass a wide variety of vehicles including, but not limited to, cars, trucks, sport utility vehicles, recreational vehicles, passenger vans, pickup trucks, station wagons, and the like. While not intended to be limiting of the present invention, the term "vehicle" may include large trucks, semi-trucks, dump trucks, cement mixing trucks, tractors, multi-axle vehicles, motorcycles, and any other type of vehicle that may require elevation by a jack.

For simplicity and brevity, the present invention is described in connection with a manually-operated jack. Typically, a manually-operated jack is the type that a user might find in the trunk of an automobile to assist with changing a tire. However, the present invention is not intended to be limited to manually-operated jacks. It is contemplated that jack may be operated by means including, but not limited to, electrical operation, hydraulic operation, pneumatic operation, electro-mechanical operation, and the like.

The present invention is contemplated to be made primarily from steel. However, the present invention is not intended to be limited solely to a steel construction. Other materials may be employed for the construction of one or more elements and/or components of the present invention. Without limiting the present invention, alternative materials include, but are not limited to, metals, metal alloys, aluminum, aluminum alloys, titanium, titanium alloys, composite materials, carbon fiber composites, ceramics, and/or combinations of these materials.

Figure 1:
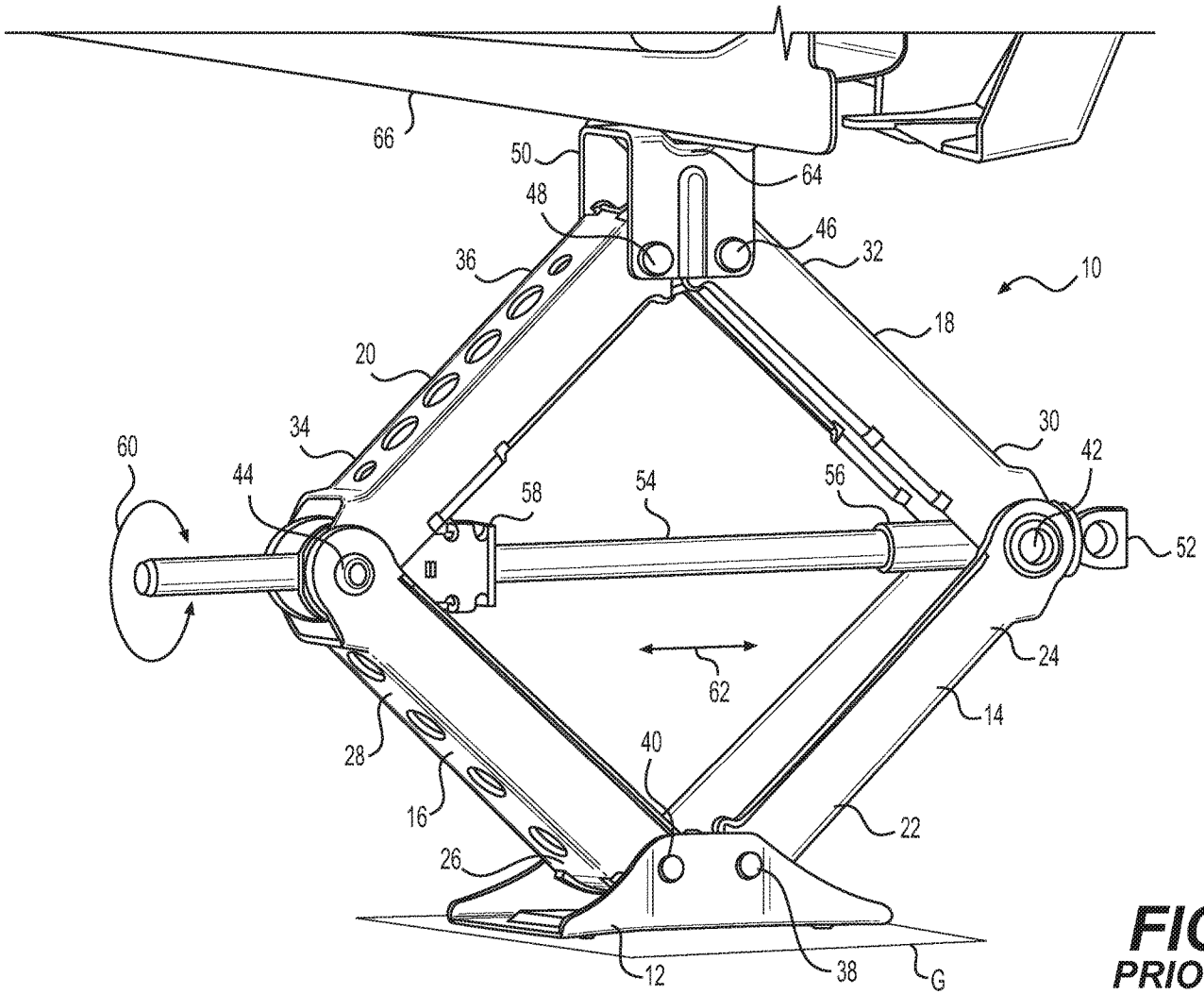
FIG. 1 PRIOR ART
FIG. 1 is a perspective illustration of a prior art vehicle jack engaging a frame element on a vehicle, with the perspective being presented from a position beneath the vehicle looking toward a side of the vehicle.

FIG. 1 is a perspective illustration of a manual jack 10 of the type that is known in the prior art.

With reference to FIG. 1, the jack 10 includes a base 12 that is contemplated to be placed onto a surface, such as the ground G. The jack 10 includes a first scissor element 14, a second scissor element 16, a third scissor element 18, and a fourth scissor element 20. The first scissor element 14 has a first end 22 and a second end 24, the second scissor element has a first end 26 and a second end 28, the third scissor element 18 has a first end 30 and a second end 32, and the fourth scissor element 20 has a first end 34 and a second end 36.

The first end 22 of the first scissor element 14 connects to the base 12 at a first joint 38. The first end 26 of the second scissor element 16 also connects to the base at a second joint 40. The second end 24 of the first scissor element 14 connects to the first end 30 of the third scissor element 18 at a third joint 42. The second end 28 of the second scissor element 16 connects to the first end 34 of the fourth scissor element 20 at a fourth joint 44. The second end 32 of the third scissor element 18 connects to a lift plate 50 at a fifth joint 46. The second end 36 of the fourth scissor element 20 also connects to the lift plate 50 at a sixth joint 48.

As illustrated, the four scissor elements 14, 16, 18, 20 establish a diamond shape for the jack 10. The elevation of the lift plate 50 is adjusted by rotating an eyelet 52. When rotated, the eyelet 52 turns a rod 54 connected thereto. The rod 54 extends through a first socket 56, disposed at the location of the third joint 42, and a second socket 58, disposed at the fourth joint 44. The rod 54 threadedly engages the first and second sockets 56, 58, which are prevented from rotation themselves, because they are fixedly mounted at the locations of the third and fourth joints 42, 44, respectively.

In operation, a user typically will connect a crank or handle (not shown) to the eyelet 52. By rotating the eyelet 52 in the direction of the arrows 60, the rod 54 rotates in the first and second sockets 56, 58, causing the third and fourth joints 42, 44 to move toward or away from one another in the direction of the arrows 62. When the third and fourth joints 42, 44 move toward one another, the lift plate 50 increases in elevation by moving away from the base 12. Conversely, when the third and fourth joints 42, 44 move away from one another, the lift plate 50 decreases in elevation by moving toward the base 12.

The lift plate 50 is constructed as a U-shaped member that connects the second ends 32, 36 of the third and fourth scissor elements 18, 20 to one another. The lift plate 50 includes a detent 64 in a top portion thereof. The detent 64 is provided to engage a frame element 66 under the vehicle.

Figure 2:
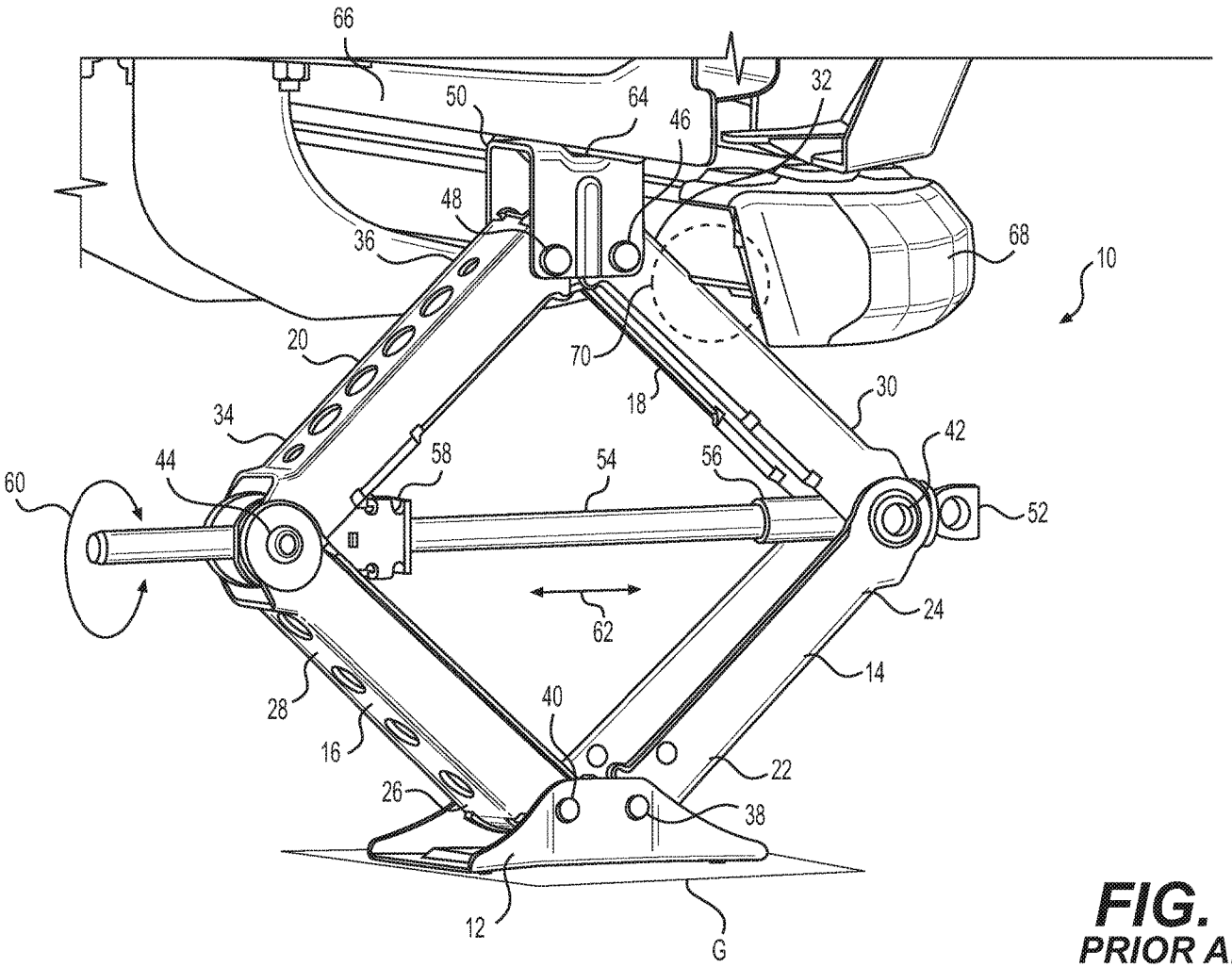
FIG. 2 PRIOR ART
FIG. 2 is a perspective illustration of a prior art manual jack illustrated in FIG. 1, highlighting the difficulty discussed above where the jack interferes with a portion of the vehicle, such as an assist step, when the jack is employed to lift the vehicle.

FIG. 2 is a perspective illustration of the jack 10 illustrated in FIG. 1. In this illustration, the jack 10 is disposed beneath a vehicle with an assist step 68, which extends outboard of the frame element 66.

As indicated in FIG. 2, a difficulty may arise when using the jack 10 on a vehicle that includes an assist step 68. In particular, the assist step 68 obstructs the operation of the manual jack 10, because the third scissor element 18 has a tendency to impact the assist step 68 at an impact area 70, which is indicated generally by a dotted-line circle.

FIGS. 3-7 illustrate aspects of a first embodiment of a jack 72 according to present invention.

Figure 3:
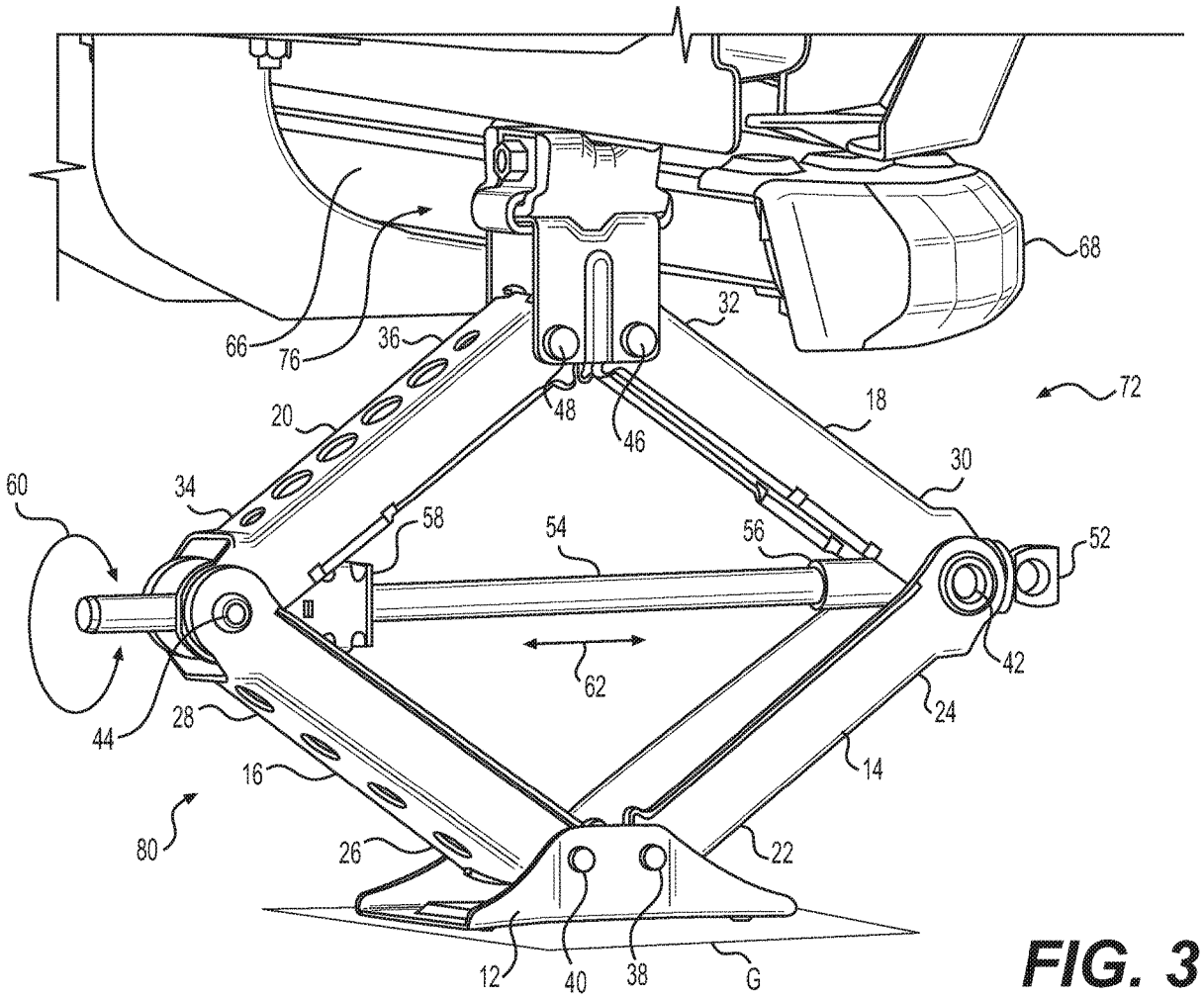
FIG. 3 is a perspective illustration of a first embodiment of the jack of the present invention, with the perspective being presented from a position beneath the vehicle looking toward a side of the vehicle, similar to the perspective presented in FIGS. 1 and 2.

FIG. 3 is a perspective illustration of the first embodiment of the jack 72. To simplify the discussion of the present invention, the jack 72 is shown with a construction that includes elements in common with the jack 10 illustrated in FIGS. 1 and 2. As such, the same reference numbers are employed to refer to the same and/or similar features, components, and/or elements. For clarity, the re-use of reference numbers is not intended to limit the scope of the present invention.

Figure 4:
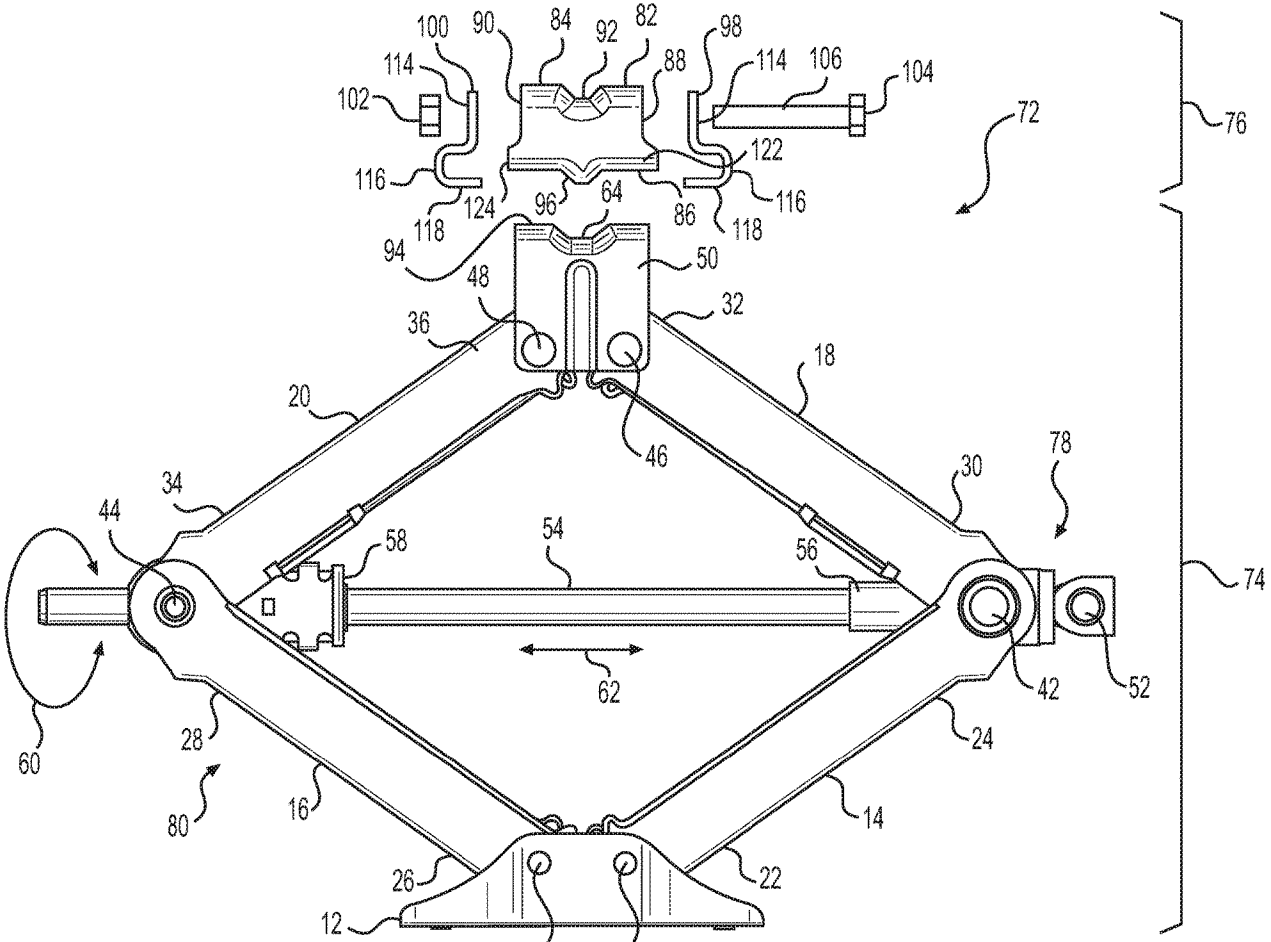
FIG. 4 is a front, elevational view of the first embodiment of the jack of the present invention illustrated in FIG. 3, showing an extension element in an exploded state.
Figure 5:
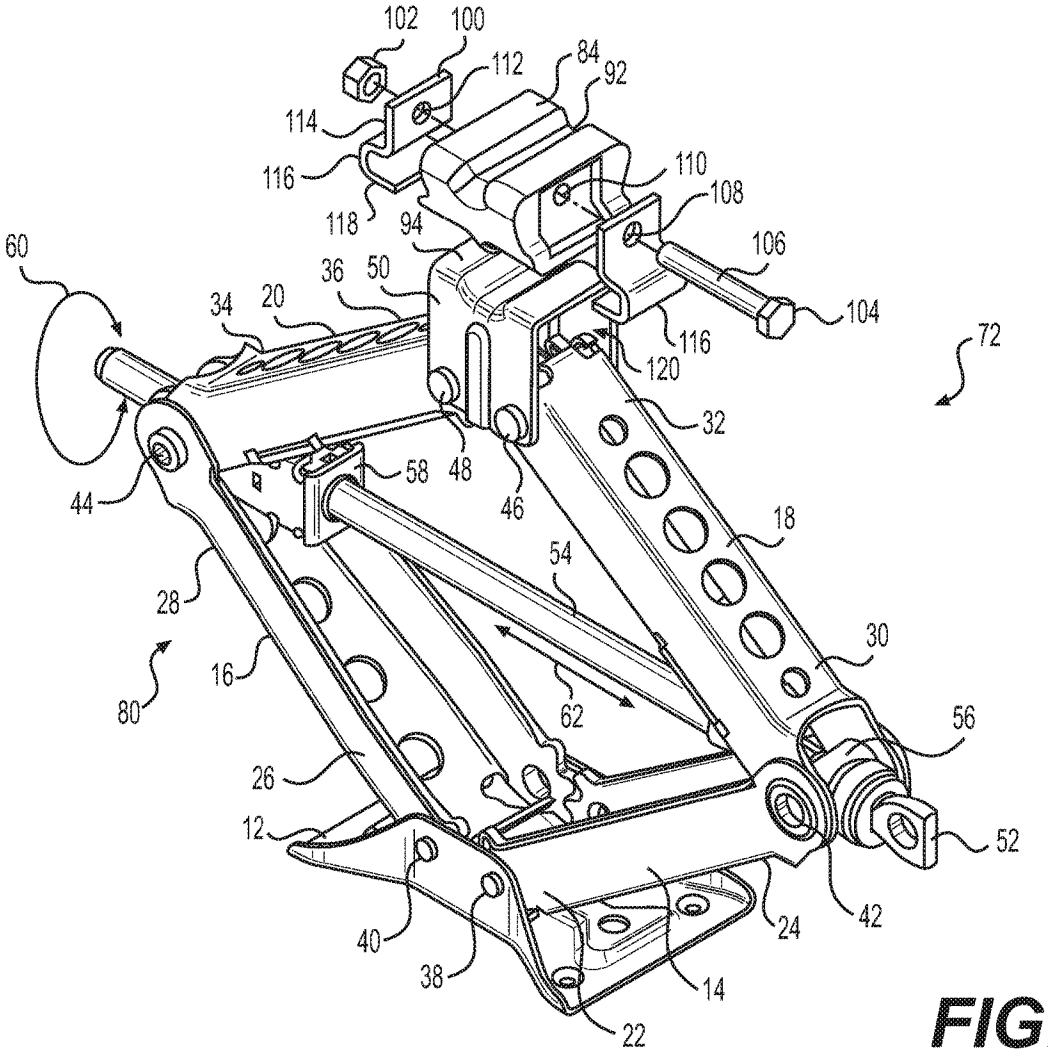
FIG. 5 is a perspective view of the first embodiment of the jack shown in FIG. 4, also illustrating the extension element in an exploded state.

As identified in FIG. 4, the jack 72 includes three basic parts: (1) a lift element 74, (2) an extension element 76, and (3) an operative element 78.

The lift element 74 encompasses at least the base 12, the four scissor elements 14, 16, 18, 20, and the lift plate 50.

Taking each of the components of the lift element 74 in turn, the base 12 is illustrated as a unitary component that supports the jack 72 on the ground G. While it is contemplated that a single base 12 is likely to be employed for the jack 72, as shown, the present invention should not be understood to be limited solely to such a construction. It is contemplated, for example, that the base 12 may be styled as separate feet that connect to the bottoms of the first and second scissor elements 14, 16. Still further, the base 12 may have an alternative, multi-piece construction, as should be apparent to those skilled in the art.

The lift element 74 includes four scissor elements 14, 16, 18, 20. While four scissor elements 14, 16, 18, 20 are likely to be employed when the jack 72 is configured for manual operation, the present invention should not be understood to be limited solely to a construction that includes only four scissor elements 14, 16, 18, 20. To the contrary, any number of scissor elements 14, 16, 18, 20 may be employed without departing from the present invention. Since the lift element 74 may include any number of scissor elements 14, 16, 18, 20, the four scissor elements 14, 16, 18, 20 are referred to collectively as a plurality of scissor elements 80.

With respect to the lift element 74, the illustrated construction includes the plurality of scissor elements 80. However, the lift element 74 may have an alternative construction that excludes the plurality of scissor elements 80 or combines the plurality of scissor elements 80 with other components when alternative operators are employed.

If the jack is actuated by an alternative operator, lift element 74 is contemplated to be tailored to the accommodate elements associated with the alternative operator. For example, if the lift element is hydraulically or pneumatically actuated, it is contemplated that the lift element 74 may include one or more pistons upon which the operative fluid acts. If the lift element 74 is electrically actuated, a motor may be involved. To that end, it is contemplated that the lift element 74 may include a hydraulic, a pneumatic, an electric, an electromechanical, or another type of actuators. As a result, in alternative, contemplated embodiments, the lift element 74 may include components that do not require a plurality of scissor elements 80. In further contemplated embodiments, the alternative actuator may cooperate with a plurality of scissor elements 80, thereby encompassing a hybrid construction. For example, a hydraulic piston may cooperate with the plurality of scissor elements 80 to raise and lower the lift plate 50.

The lift plate 50 for the jack 72 is illustrated as being a U-shaped member with a detent 64 in the top side 94. It is noted, however, that the lift plate 50 may have any suitable construction without departing from the scope of the present invention. For example, the detent 64 is not required to practice the present invention. Still further, the lift plate 50 may be configured as a solid block of a suitable material, which may enhance the load capacity of the jack 72. As should be apparent to those skilled in the art, there are a limitless number of configurations for the lift plate 50 that may be employed without departing from the scope of the present invention.

The jack 72 shown in FIGS. 3-7 is manually operated. The operative element 78 raises and lowers the lift plate 50 in relation to the base 12. The operative element 78 includes at least the eyelet 52, the rod 54, the first socket 56, and the second socket 58. When the eyelet 52 is rotated in the direction of the arrows 60, the threaded rod 54 engages the first and second sockets 56, 58, causing the first and second sockets 56, 58 to move long the rod 54 in the directions of the arrows 62. The sockets 56, 58 are connected at the joints 42, 44. Accordingly, when the sockets 46, 58 move in the direction of the arrows 62, the plurality of scissor elements 80 move to push the lift plate 50 and the base apart or to the lift plate 50 and the base 12 together. As noted above, the construction of the jack 72 is only one of a number of contemplated embodiments.

The extension element 76, which is described in greater detail below, is attached to the lift plate 50. The extension element 76 alters the interaction between the jack 72 and the vehicle to avoid the creation of any impact areas 70 between the jack 72 and any associated components, such as an assist step 68, attached to the vehicle. As discussed in connection with FIGS. 10-13, for example, the extension element 76 is contemplated to provide a stable interface with the lift plate 50.

The base 12, the lift element 74, the extension element 76, and the operative element 78, together with their associated components, are contemplated to be made from a metal, such as steel. While steel is contemplated to be the typical material employed, the present invention should not be understood to be limited solely to steel. Other metals may be employed without departing from the scope of the present invention. Without limiting the present invention, alternative metals include aluminum, alloys of aluminum, iron, alloys of iron, nickel, alloys of nickel, titanium, alloys of titanium, magnesium, alloys of magnesium, and the like. Still further materials that may be employed include, but are not limited to, natural materials (e.g., wood), composite materials, carbon fiber composite materials, ceramics, plastics, and the like. Still further, all of the elements of the jack 72 need not be made from the same material. Selected components may be made from different materials, as required or as desired.

Details of the extension element 76 are illustrated in FIG. 4, which provides a front view of the jack 72. The extension element 76 shown in exploded detail in this figure.

As illustrated in FIG. 4, the extension element 76 include a main body 82 with a top side 84, a bottom side 86, a first side 88, and a second side 90. The top side 84 includes a detent 92 that mirrors the shape of the detent 64 in the top side 94 of the lift plate 50. The detent 92 is shaped to accommodate a frame element 66 from a vehicle therein. The bottom side 86 includes a protrusion 96 that has a shape complimentary to the shape of the detent 64. The protrusion 96, therefore, is contemplated to be secured within the detent 64 when the body 82 is secured to the lift plate 50.

To secure the body 82 to the lift plate 50, the extension element 76 includes a first bracket 98 and a second bracket 100. The first and second brackets 98, 100 are shaped to be mirror images of one another. The first and second brackets 98, 100 have shapes that are complimentary to the shapes of the first and second sides 88, 90 of the body 82. When attached to the body 82, the first and second brackets 98, 100 abut against the first and second sides 88, 90, respectively. Accordingly, when connected to the body 82, the first and second brackets 98, 100 sandwich the body 82 between them.

The first and second brackets 98, 100 and the body 82 are secured to one another by a nut 102 and a bolt 104. The bolt 104 has a stem 106 that passes through holes 108, 110, 112 in the first bracket 98, the body 82, and the second bracket 100, respectively. The holes 108, 110, 112 are shown in the perspective view provided in FIG. 5.

Each of the first and second brackets 98, 100 are shaped as inverted question marks. As such, each of the first and second brackets 98, 100, include a top portion 114 and a U-shaped bottom portion 116. The U-shaped bottom portion 116 includes a leg 118 that is inserted into openings 120 at the sides of the lift pate 50, thereby securing the extension element 76 to the lift plate 50. The openings 120 are visible in the perspective provided in FIG. 5.

The body 82, first bracket 98, second bracket 100, nut 102, and bolt 104 are contemplated to be made from steel. However, as noted above in connection with the construction of the jack 72, the present invention is not contemplated to be limited to any particular material. Alternative materials are listed above and are applicable equally to each of the components of the extension element 76.

It is noted that the body 82 may be a solid block of material, such as steel, or it may be manufactured to have a hollow or partially hollow construction. Without limiting the scope of the present invention, the body 82 illustrated in FIGS. 3-7 is contemplated to be made from a solid block of material.

Figure 6:
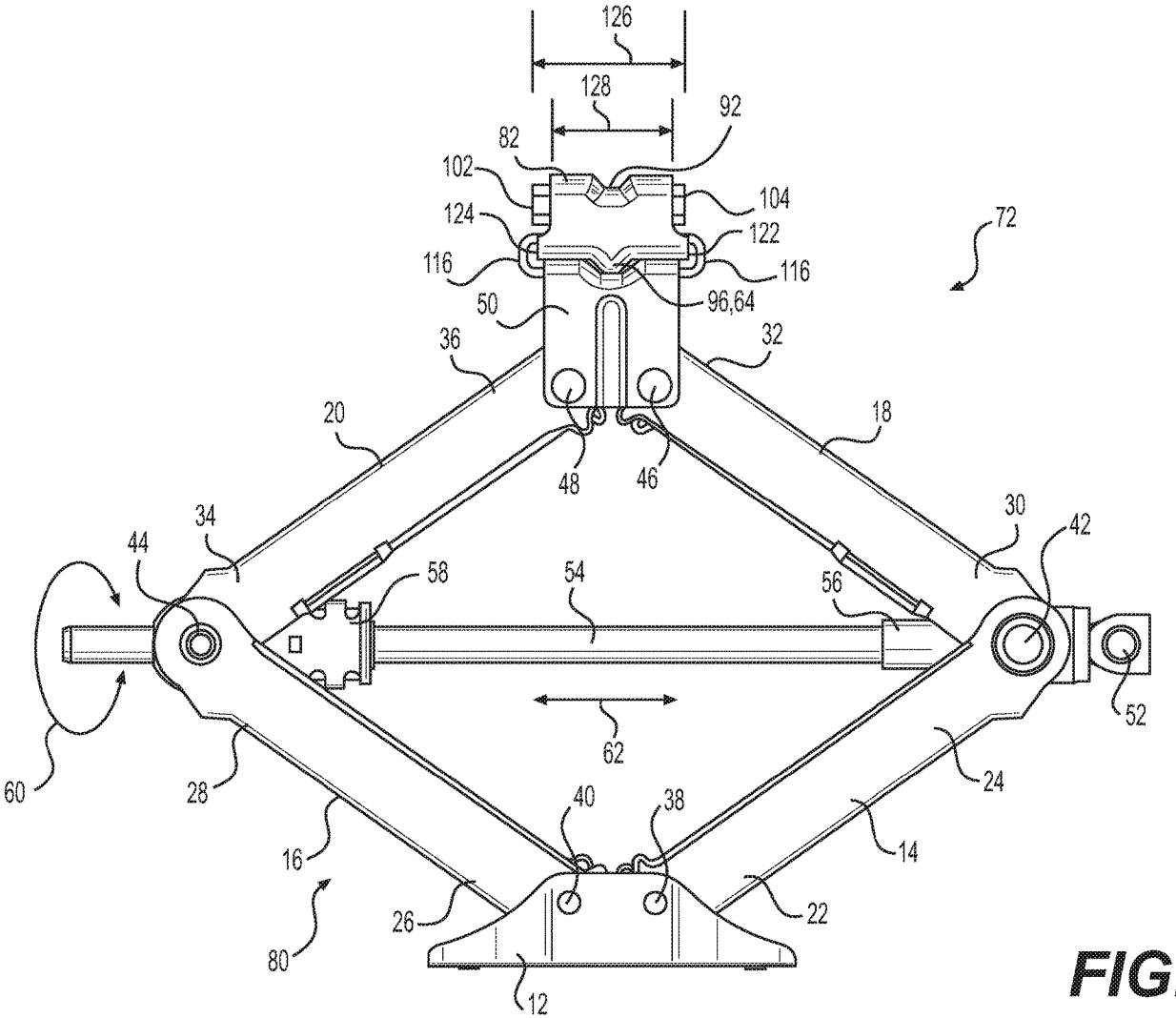
FIG. 6 is a front, elevational view of the first embodiment of the jack illustrated in FIGS. 3-5, showing the extension element in an assembled condition.

FIG. 6 is a front, plan view of the jack 72. This illustration shows the extension element 76 as it appears when attached to the lifting plate 50. It is noted that the protrusion 96 does not present a shape that is fully complimentary to the shape of the detent 64. As illustrated, the protrusion 96 fits within the detent 64 but is not shaped to be an exact match to the shape of the detent 64. As should be apparent, in an alternative construction, the protrusion 96 may be constructed to have the same shape as the shape of the detent 64 without departing from the scope of the present invention.

With continued reference to FIG. 6, it is noted that the body 82 includes first and second bulges 122, 124 that extend laterally outwardly from a position near to the bottom side 86 of the body 82. The first and second bulges 122, 124 cooperate with the U-shaped bottom portions 116 of the first and second brackets 98, 100 to secure the body 82 to the lift plate 50.

In an alternative embodiment, it is contemplated that the body 82 may not include the first and second bulges 122, 124.

As also should be apparent from FIG. 6, the first and second bulges 122, 124 at the bottom side 86 of the body 82 establish a width 126 for the body 82 that is larger (or greater) than a width 128 of the lift plate 50. As discussed in connection with FIGS. 10-13, the first and second bulges 122, 124 expand the area of the bottom side 86 of the body 82 to establish a stable interface between the extension element 76 and the lift element 74.

Figure 7:
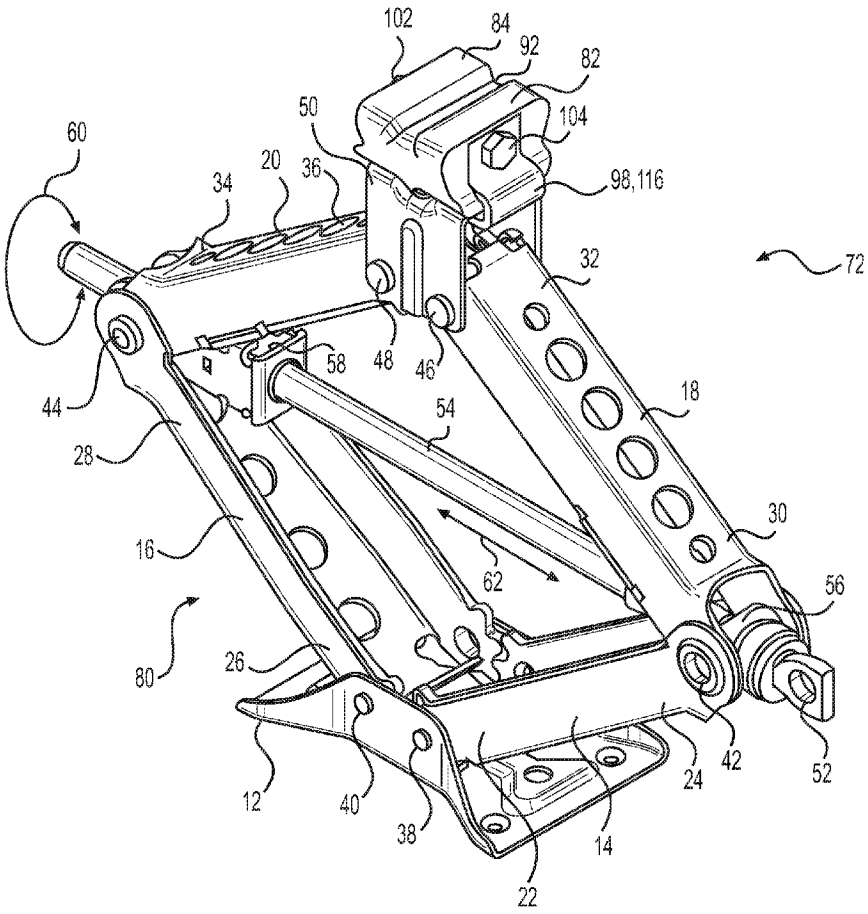
FIG. 7 is a perspective view of the first embodiment of the jack illustrated in FIG. 6, also showing the extension element in an assembled condition.

FIG. 7 is a perspective illustration of a first embodiment of the jack 72. This illustration provides a perspective view of the jack 72 in an assembled condition. The extension element 76 is connected to the lift plate 50 in the manner discussed above.

Figure 8:
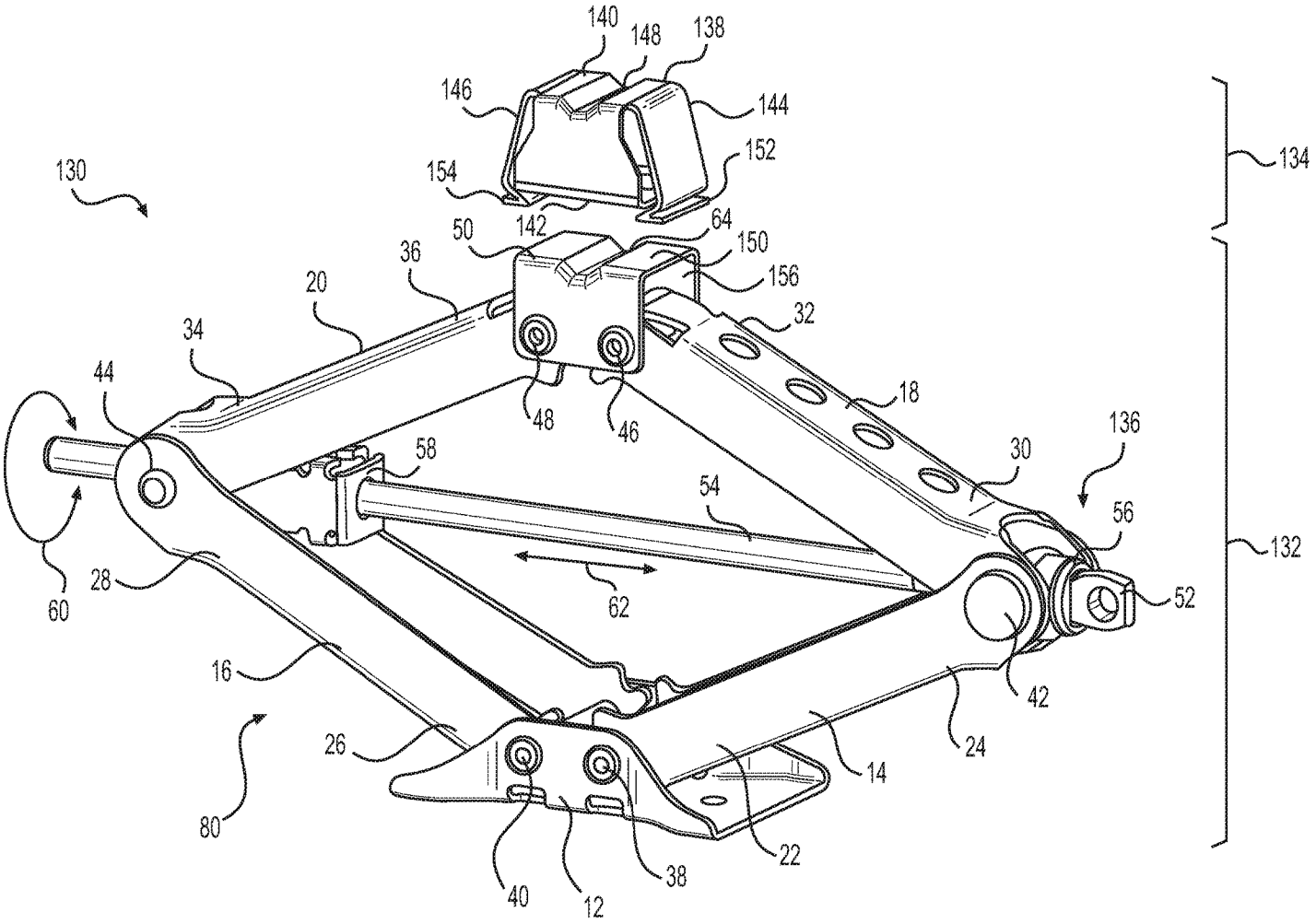
FIG. 8 is a perspective illustration of a second embodiment of the jack of the present invention, showing the extension element separated from the associated lift plate.
Figure 9:
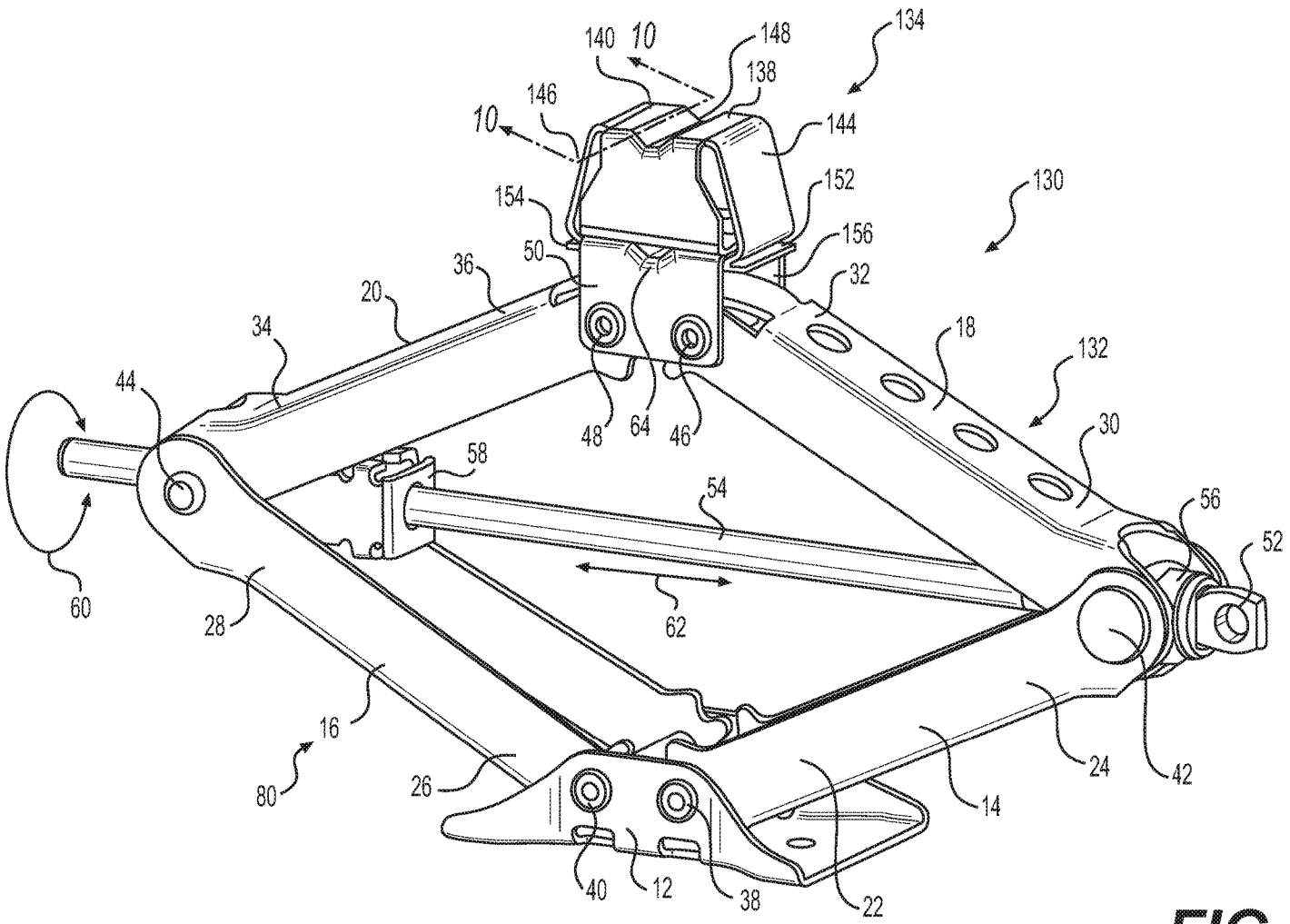
FIG. 9 is a perspective illustration of the second embodiment of the jack of the present invention illustrated in FIG. 8, showing the extension element attached to the lift plate.

FIGS. 8-9 illustrate aspects of a second embodiment of a jack 130 according to present invention.

Like the jack 72, the jack 130 includes a lift element 132, an extension element 134, and an operative element 136.

Similar to the lift element 74, the lift element 132 encompasses at least the base 12, the plurality of scissor elements 80, and the lift plate 50.

In addition, like the prior embodiment, the operative element 136 includes at least the eyelet 52, the rod 54, the first socket 56, and the second socket 58.

Still further, as with the jack 72, the extension element 134 is attached to the lift plate 50. As before, the extension element 134 alters the interaction between the jack 130 and the vehicle to avoid the creation of impact areas 70 between the jack 130 and any assist step 68 (or other obstruction) that may be attached to the vehicle.

In this second embodiment of the jack 130, the extension element 134 differs in its construction from the extension element 76.

Here, the extension element 134 has a body 138 that is trapezoidally shaped. The body 138 has a top side 140, a bottom side 142, a first side 144, and a second side 146. The top side 140 includes a detent 148 that is configured to engage a frame element 66 on a vehicle. The bottom side 142 of the body 138 abuts against a top side 150 of the lift plate 50.

The extension element 134 includes a first attachment element 152 connected to the first side 144 and a second attachment element 154 connected to the second side 146. The first attachment element 152 attaches to the lift plate 50 by being inserted into the opening 156 defined by the U-shaped lift plate 50. Similarly, the second attachment element 154 attaches to the lift plate 50 by being inserted into the opening 156 defined by the U-shaped lift plate 50.

As with the first embodiment, the bottom side 142 of the extension element 134 is shaped and sized to provide a stable interface between the body 138 and the lift plate 50.

FIG. 9 is a perspective illustration of the jack 130, with the extension element 134 shown connected to the lift plate 50.

Figure 10:
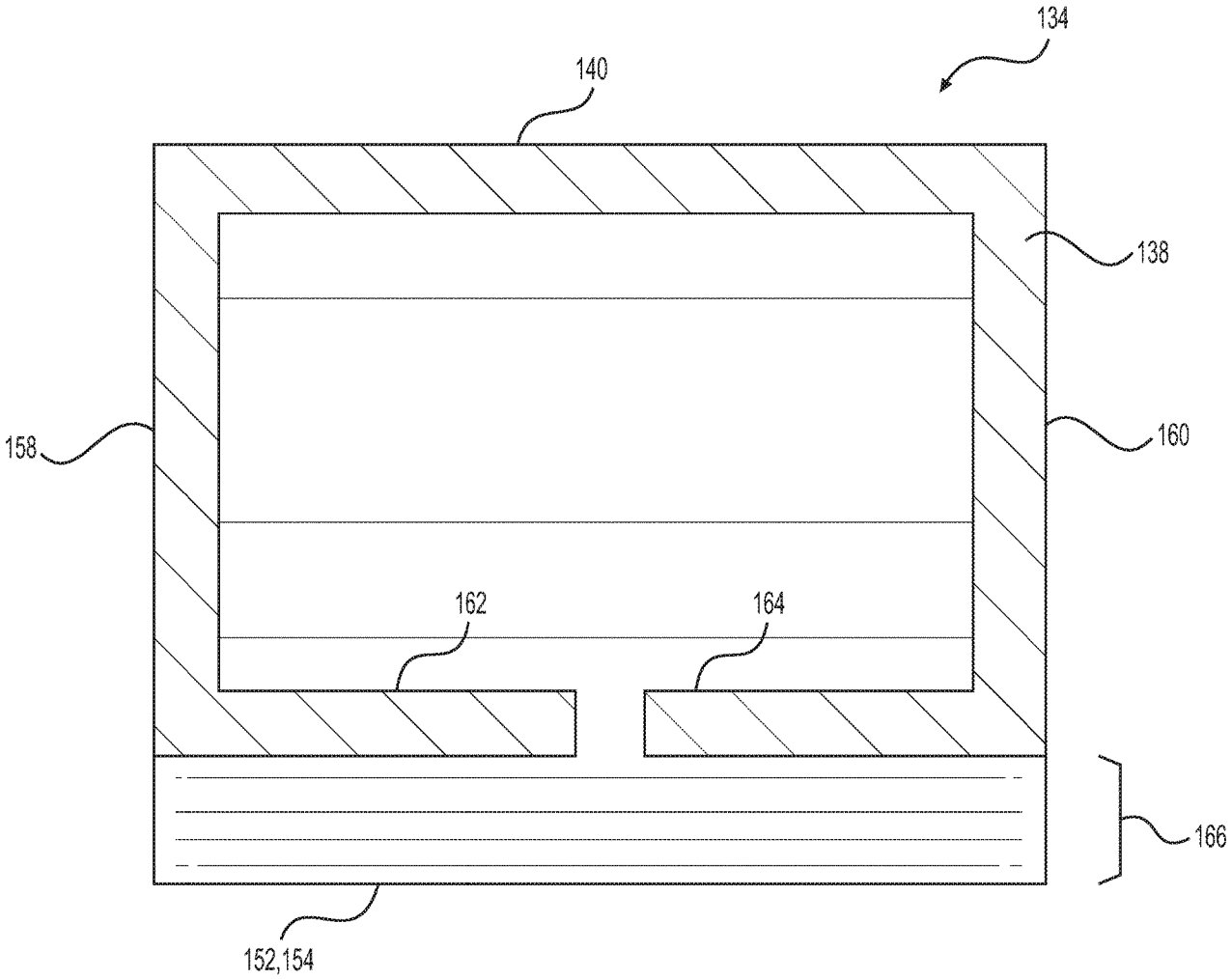
FIG. 10 is a graphical, cross-sectional representation of the extension element illustrated in FIGS. 8 and 9, providing additional detail with respect to the construction of the extension element.

FIG. 10 provides a graphical, cross-sectional representation of the extension element 134 according to the second embodiment of the jack 130 of the present invention. The cross-section is taken along the direction of the line 10-10, as indicated in FIG. 9.

As illustrated, the extension element 134 is contemplated to be constructed as a hollow body stamped from a sheet of metal, such as steel. As such, the front side 158 and the rear side 160 include first and second tabs 162, 164 that abut against the top side 150 of the lift plate 50.

The first and second attachment elements 152, 154 extend downwardly from the top side 140 of the body 138 and terminate in tabs 166 that are U-shaped. As should be apparent to those skilled in the art, the tabs 166 permit the body 138 to be press-fitted onto the lift plate 50. Once fitted onto the lift plate 50, as illustrated in FIG. 9, the extension element 134 is secured to the lift plate 50, because the lift plate 50 is grasped by the first and second attachment elements 152, 154.

As may be apparent from FIGS. 3-9, the extension elements 76, 134 may be removably attached to the lift plate 50. As such, the extension elements 76, 134 also may function as adapters 76, 134 that may be provided for incorporation into a jack, such as the jack 10 discussed in connection with the prior art.

As also should be apparent from the foregoing discussion, the extension elements 76, 134 may be attached to the lift plate 50 via any alternative connection(s) and/or means. In other words, the present invention is not intended to be limited to the specific embodiments described. Instead, the present invention is intended to encompass alternatives for attaching the extension elements 76, 134 to the lift plate 50.

Figure 11:
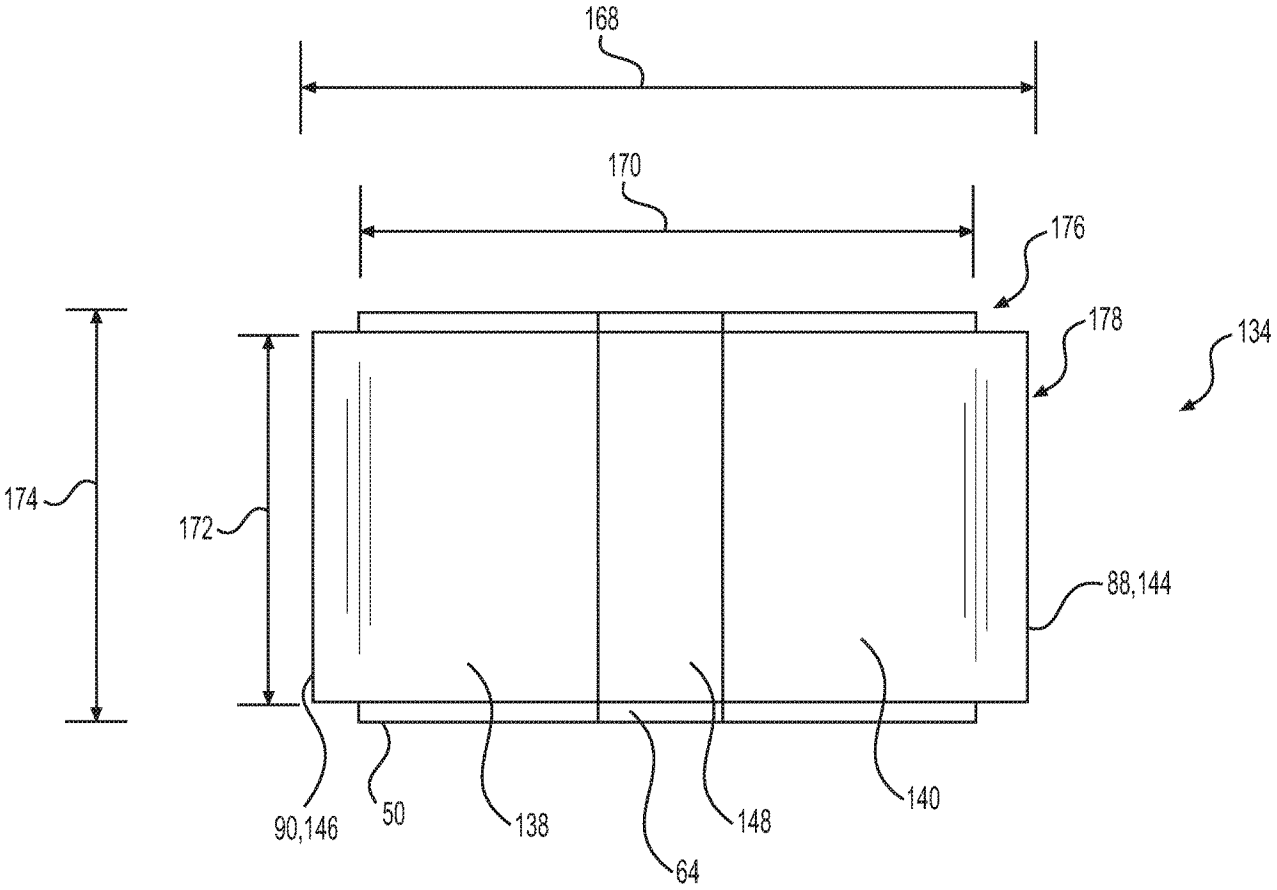
FIG. 11 is a graphical, top view of the extension element and the lift plate illustrated in FIGS. 8-10, illustrating a first positional relationship between the extension element and the lift plate.
Figure 12:
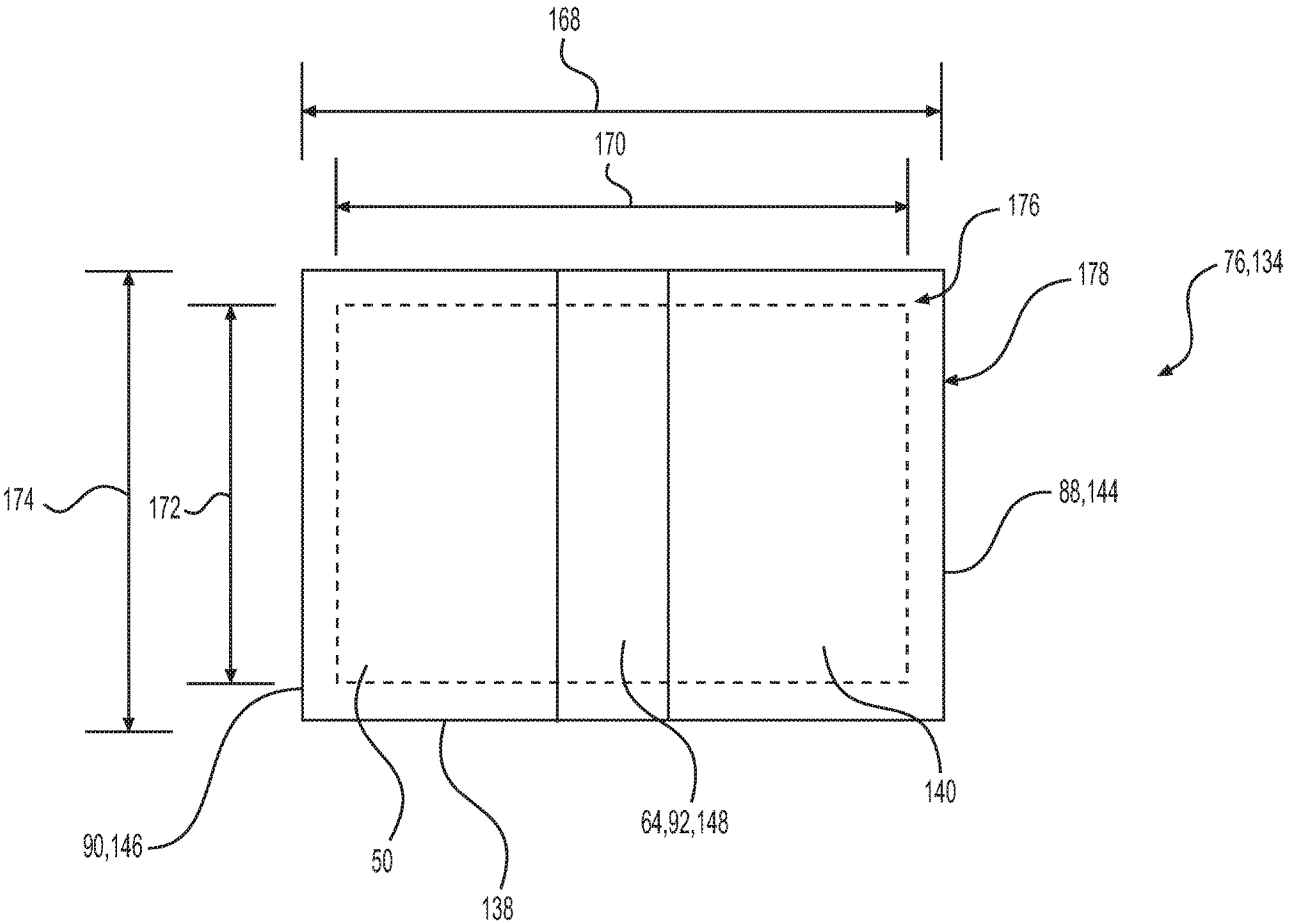
FIG. 12 is a graphical, top view of the extension element and the lift plate of the present invention, illustrating a second positional relationship between the extension element and the lift plate.
Figure 13:
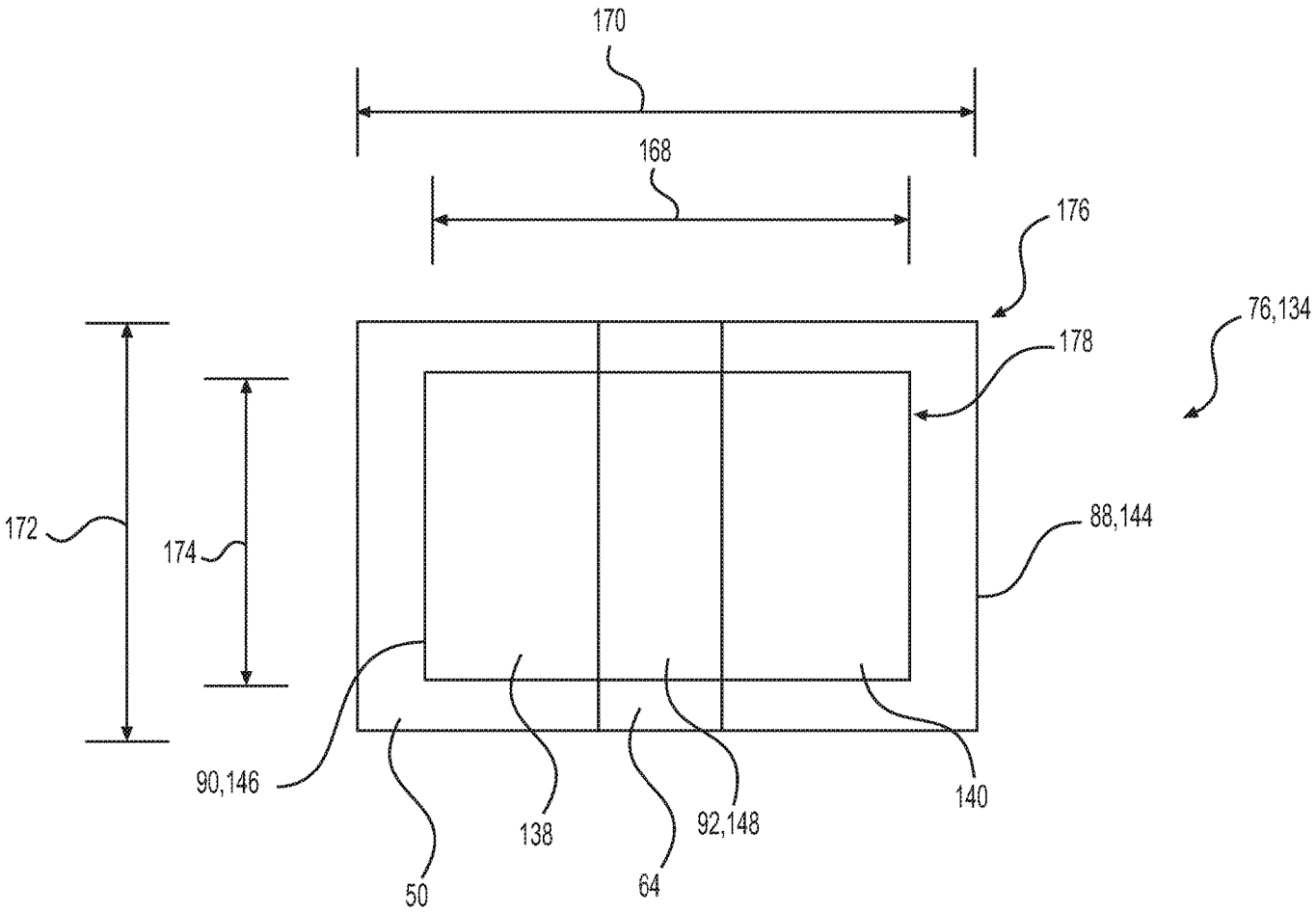
FIG. 13 is a graphical, top view of the extension element and lift plate of the present invention, illustrating a third positional relationship between the extension element and the lift plate.

FIGS. 11-13 are graphic illustrations that highlight one aspect of the jack 72, 130 according to the present invention. In particular, it is contemplated that the extension element 76, 134 may have a cross-sectional area that is within a range of 0.8 to 1.2 times the size of the cross-sectional area of the top side 94, 150 of the lift plate 50. It is contemplated that, when the ratio falls within this range, the extension element 76, 134 will provide a stable interface between the extension element 76, 134 and the lift element 74, 132.

FIGS. 11-13 illustrate three non-limiting variations of this aspect of the present invention.

FIG. 11 illustrates an arrangement that is consistent with the jack 130 illustrated in FIGS. 8-10. In this embodiment, width 168 of the extension element 134 is greater than the width 170 of the lift plate 50. The depth 172 of the extension element 134 is illustrated as being less than the depth 174 of the lift plate 50.

While the construction illustrated in FIG. 11 is consistent with the embodiment of the extension element 134, it is contemplated that the widths 168, 170 and depths 172, 174 may be altered without departing from the scope of the present invention.

In particular, it is contemplated that a ratio between an area 176 of the top side 150 of the lift plate 50 and an area 178 of the bottom side 142 of the extension element 134 will be between about 0.8 and 1.2. In a further contemplated embodiments, the ratio may be between about 0.85 to 1.15, about 0.9 to 1.1, and about 0.95 to 1.05. It is anticipated that a commonly-employed ratio may be about 1.0 in still other embodiments.

In a contemplated embodiment of the present invention, a ratio of about 1.2 is illustrated in FIG. 12. In this embodiment, the area 176 of the top side 150 of the lift plate 50 is less than the area 178 of the bottom side 86, 142 of the body 82, 138. As should be apparent, this relationship is consistent with the first embodiment of the jack 72 illustrated in FIGS. 3-7.

A ratio of about 0.8 is illustrated in FIG. 13. In this embodiment, the area 176 of the top side 150 of the lift plate 50 is greater than the area 178 of the bottom side 86, 142 of the body 82, 138.

While not shown, it is contemplated that the ratio may be about 1.0. As such, the area 176 of the top side 150 of the lift plate 50 will be equal to the area 178 of the bottom side 86, 142 of the body 82, 138.

It is contemplated that, by maintaining the ratio between the areas 176, 178 in a range of 0.8 to 1.2, the bottom side 86, 142 of the body 82, 138 will present a sufficient surface to establish a stable interface with the top side 94, 150 of the lift plate 50. Specifically, the body 82, 138 is contemplated to be stably supported on the lift plate 50 so that the body 82, 138 is not easily dislodged with respect to the lift plate 50. In other word, the ratio is understood to provide a stable interface between the lift plate 50 and the body 82, 138 to provide stable lifting of the vehicle by the jack 72, 130. It is contemplated that a ratio of less than 0.8 may result in an unstable relationship between the body 82, 138 and the lift plate 50 such that the body 82, 138 may be dislodged when subjected to the weight of the vehicle.

As noted above, the embodiment(s) described herein are intended to be exemplary of the wide breadth of the present invention. Variations and equivalents of the described embodiment(s) are intended to be encompassed by the present invention, as if described herein.

What is claimed is:

1. A vehicle jack, comprising:

a lift element;

an operative element operably connected to the lift element to transition the lift element from a first position to a second position, wherein the first position differs in elevation from the second position; and an extension element affixed to the lift element, wherein the extension element comprises:

a body comprising:

a top side;

a first side connected to and extending downwardly from the top side, a second side connected to and extending downwardly from the top side, a front side connected to and extending downwardly from the top side;

a rear side connected and extending downwardly from the top side, a first tab connected to a bottom of the front side and extending toward the rear side, and a second tab connected to a bottom of the rear side and extending toward the front side, wherein the first tab and the second tab define a bottom side that is adapted to be positioned atop the lift element, a first attachment element associated with the first side of the body, and a second attachment element associated with the second side of the body, wherein the first attachment element and the second attachment element engage the lift element to secure the body to the lift element, thereby establishing a stable interface between the body and the lift element.

2. The vehicle jack of claim 1, wherein the lift element comprises:

a base;

a lift plate with a top side defining a first area; and a plurality of scissor elements connecting the base to the lift plate;

wherein the bottom side of the body defines a second area, and wherein a ratio of the first area to the second area is between 0.8-1.2.

3. The vehicle jack of claim 2, wherein the ratio is between 0.9-1.1.

4. The vehicle jack of claim 3, wherein the ratio is between 0.95-1.05.

5. The vehicle jack of claim 4, wherein the ratio is 1.0.

6. The vehicle jack of claim 2, wherein the first attachment element and the second attachment element engage the lift plate to secure the body to the lift plate.

7. The vehicle jack of claim 6, wherein the body includes a detent in a top side for engagement with a frame element on a vehicle.

8. The vehicle jack of claim 6, wherein:

the first attachment element is attached to the first side of the body, and the second attachment is attached to the second side of the body.

9. The vehicle jack of claim 2, wherein the operative element further comprises:

an eyelet;

a rod connected to the eyelet;

a first socket engaging a first end of the rod and the plurality of scissor elements; and a second socket engaging a second end of the rod and the plurality of scissor element, wherein rotation of the eyelet causes rotation of the rod, wherein rotation of the rod causes the first and second sockets to move therealong, thereby causing the first and second sockets to move in relation to one another, and wherein, as the first and second sockets move along the rod, the plurality of scissor elements cause the base and the lift plate to move in relation to one another.

10. The vehicle jack of claim 2, wherein:

the plurality of scissor elements comprise a first scissor element, a second scissor element, a third scissor element, and a fourth scissor element, and the plurality of scissor elements connect to one another to form a diamond shape.

11. The vehicle jack of claim 10, wherein:

the first and second scissor elements connect at first ends to the base, the first and second scissor elements connect at second ends to third ends of the third and fourth scissor elements, and the third and fourth scissor elements connect at fourth ends to the lift plate.

12. The vehicle jack of claim 1, wherein the lift element comprises at least one material selected from a group comprising steel, aluminum, alloys of aluminum, iron, alloys of iron, nickel, alloys of nickel, titanium, alloys of titanium, magnesium, alloys of magnesium, natural materials, composite materials, carbon fiber composite materials, ceramics, and plastics.

13. The vehicle jack of claim 1, wherein the extension element comprises at least one material selected from a group comprising steel, aluminum, alloys of aluminum, iron, alloys of iron, nickel, alloys of nickel, titanium, alloys of titanium, magnesium, alloys of magnesium, natural materials, composite materials, carbon fiber composite materials, ceramics, and plastics.

14. The vehicle jack of claim 1, wherein the operative element comprises at least one material selected from a group comprising steel, aluminum, alloys of aluminum, iron, alloys of iron, nickel, alloys of nickel, titanium, alloys of titanium, magnesium, alloys of magnesium, natural materials, composite materials, carbon fiber composite materials, ceramics, and plastics.

15. An extension element for a vehicle jack, comprising:

a body comprising:

a top side;

a first side connected to and extending downwardly from the top side, a second side connected to and extending downwardly from the top side, a front side connected to and extending downwardly from the top side;

a rear side connected and extending downwardly from the top side, a first tab connected to a bottom of the front side and extending toward the rear side, and a second tab connected to a bottom of the rear side and extending toward the front side, wherein the first tab and the second tab define a bottom side defining a first area that is adapted to be positioned atop the lift element having a top side with a second area;

a first attachment element associated with the first side of the body; and a second attachment element associated with the second side of the body;

wherein the first attachment element and the second attachment element engage the lift element to secure the body to the lift element, and wherein the bottom side establishes a stable interface with the lift element.

16. The extension element of claim 15, wherein a ratio of the first area to the second area is between 0.8-1.2.

17. The extension element of claim 16, wherein the ratio is between 0.9-1.1.

18. The extension element of claim 17, wherein the ratio is between 0.95-1.05.

19. The extension element of claim 18, wherein the ratio is 1.0.

* * * * *